US010156053B2

(12) United States Patent
Hren

(10) Patent No.: US 10,156,053 B2
(45) Date of Patent: Dec. 18, 2018

(54) BOOM AND DIPPER HANDLE ASSEMBLY FOR AN INDUSTRIAL MACHINE

(71) Applicant: Harnischfeger Technologies, Inc., Wilmington, DE (US)

(72) Inventor: William Hren, Wauwatosa, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 287 days.

(21) Appl. No.: 13/831,295

(22) Filed: Mar. 14, 2013

(65) Prior Publication Data

US 2013/0259625 A1 Oct. 3, 2013

Related U.S. Application Data

(60) Provisional application No. 61/619,361, filed on Apr. 2, 2012.

(51) Int. Cl.
*E02F 3/30* (2006.01)
*E02F 3/38* (2006.01)
(Continued)

(52) U.S. Cl.
CPC ..... *E02F 3/304* (2013.01); *E02F 3/38* (2013.01); *E02F 3/46* (2013.01); *E02F 9/14* (2013.01)

(58) Field of Classification Search
CPC ... E02F 3/304; E02F 3/308; E02F 3/38; E02F 3/435
(Continued)

(56) References Cited

U.S. PATENT DOCUMENTS 1,457,301 A * 6/1923 Ferris et al. ..... 414/693
1,599,630 A * 9/1926 Bager ..... E02F 3/3604 414/726
(Continued)

FOREIGN PATENT DOCUMENTS

CA 2141164 4/1996
CA 2333835 8/2001
(Continued)

OTHER PUBLICATIONS

Second Office Action from the Australian Intellectual Property Office for Application No. 2015261597 dated Oct. 7, 2016 (6 pages).
(Continued)

*Primary Examiner* — Ronald P Jarrett
(74) *Attorney, Agent, or Firm* — Michael Best & Friedrich LLP

(57) ABSTRACT

A mining machine includes a base, a boom, a member, and a dipper. The base includes a frame portion that is rotatable relative to the support surface about a machine axis. The boom includes a first end coupled to the base, a second end opposite the first end, and a sheave coupled to the second end of the boom. A first distance is defined between the machine axis and the second end of the boom. The member is movably coupled to the boom about a pivot point that is positioned substantially between the first end and the second end of the boom. A second distance is defined between the machine axis and the pivot point. A ratio of the second distance to the first distance is between 27% and 43%. The dipper is coupled to an end of the member and is supported by a hoist rope.

30 Claims, 11 Drawing Sheets

(51) Int. Cl.
*E02F 3/46* (2006.01)
*E02F 9/14* (2006.01)

(58) Field of Classification Search
USPC ..... 701/50; 414/685; 37/394–399, 443
See application file for complete search history.

(56) References Cited

U.S. PATENT DOCUMENTS

| | | | | |
|---|---|---|---|---|
| 1,769,991 | A * | 7/1930 | Fundom | 414/690 |
| 2,211,783 | A | 8/1940 | Knox | |
| 3,580,405 | A * | 5/1971 | Siegel | E02F 3/30 414/690 |
| 5,469,647 | A | 11/1995 | Profio | |
| 6,314,667 | B1 * | 11/2001 | Rife et al. | 37/397 |
| 6,434,862 | B1 * | 8/2002 | Hren | 37/398 |
| 2005/0150141 | A1 | 7/2005 | Suzik et al. | |

FOREIGN PATENT DOCUMENTS

| | | |
|---|---|---|
| CN | 86204530 | 12/1987 |
| CN | 2866627 | 2/2007 |

OTHER PUBLICATIONS

First Office Action from the State Intellectual Property Office of China for Application No. 201310113111.9 dated Jun. 2, 2016 (17 pages).

* cited by examiner

BOOM AND DIPPER HANDLE ASSEMBLY FOR AN INDUSTRIAL MACHINE

CROSS-REFERENCE TO RELATED APPLICATIONS

This application claims the benefit of U.S. Provisional Patent Application No. 61/619,361, filed Apr. 2, 2012, the entire contents of which are incorporated herein by reference.

BACKGROUND OF THE INVENTION

The present invention relates to a boom and a dipper handle for an industrial machine, such as an electric rope or power shovel.

In the mining field, and in other fields in which large volumes of material must be collected and removed from a work site, it is typical to employ industrial machines including a large dipper for shoveling the materials from the work site. Industrial machines, such as electric rope or power shovels, draglines, etc., are used to execute digging operations to remove material from, for example, a bank of a mine. Electric rope shovels typically include a shovel boom, a handle movably coupled to the boom and supporting the dipper, and a pulley or boom sheave rotatably supported on the boom. The handle supports the dipper while the dipper is removing material from the bank. A hoist rope extends over a portion of the boom sheave and is connected to the dipper to raise and lower the dipper, thereby producing an efficient digging motion to excavate the bank of material.

Due to the current configuration and position of the boom and the handle of electric rope shovels, shovel operators generally have difficulties maneuvering the dipper and the dipper handle in the tuck back region of the shovel. Newer shovels also have an increased payload and a larger dipper that reduces the maneuverability of the dipper and the handle even further. At the same time, operators must maintain the flat floor cleaning distance of the shovel and be able to securely and accurately unload the dipper into a vehicle. Due to the payload increase, truck bed heights have also increased, making it harder for the shovel operator to accurately unload the dipper. Increasing the payload, the bail pull, and the reach of a shovel is detrimental to the shovel as it leads to a higher tipping moment range and a higher machine weight because of the necessary counterweight added to the shovel and increased required strength of the structures. This increases the swing inertia (i.e., cycle time), the front idler loading, and the rocking of the shovel that can lead to a lower structural life.

SUMMARY OF THE INVENTION

In one embodiment, the invention provides a mining machine supported on a support surface. The mining machine includes a base, a boom, a hoist rope, a member, and a dipper. The base includes a frame portion that is rotatable relative to the support surface about a machine axis. The boom includes a first end coupled to the base, a second end opposite the first end, and a sheave coupled to the second end of the boom. A first distance is defined between the machine axis and the second end of the boom. The hoist rope extends over the sheave. The member is movably coupled to the boom about a pivot point that is positioned substantially between the first end and the second end of the boom. A second distance is defined between the machine axis and the pivot point. A length ratio of the second distance to the first distance is between 27% and 43%. The dipper is coupled to an end of the member and is supported by the hoist rope so that the hoist rope raises the dipper as the rope is reeled in.

In another embodiment, the invention provides a mining machine supported on a support surface. The mining machine includes a base, a boom, a hoist rope, a member, and a dipper. The boom includes a first end coupled to the base, a second end opposite the first end, and a sheave coupled to the second end of the boom. A first height is defined between the support surface and the second end of the boom. The hoist rope extends over the sheave. The member is movably coupled to the boom about a pivot point that is positioned substantially between the first end and the second end of the boom. A second height is defined between the support surface and the pivot point, and a height ratio of the second height to the first height is between 50% and 64%. The dipper is coupled to an end of the member and is supported by the hoist rope such that the hoist rope raises the dipper as the rope is reeled in.

In yet another embodiment, the invention provides a boom for a mining machine including a base and a handle. The boom includes a first end adapted to be coupled to the base, a second end adapted to support a sheave; a boom axis extending through the first end and the second end, and a shipper shaft extending through a width of the boom and defining a transverse axis. A boom distance is defined between the first end and the second end. The shipper shaft is positioned between the first end and the second end. A first distance is defined between the first end of the boom and the shipper shaft, and a first ratio of the first distance to the boom distance is between 20% and 33%.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
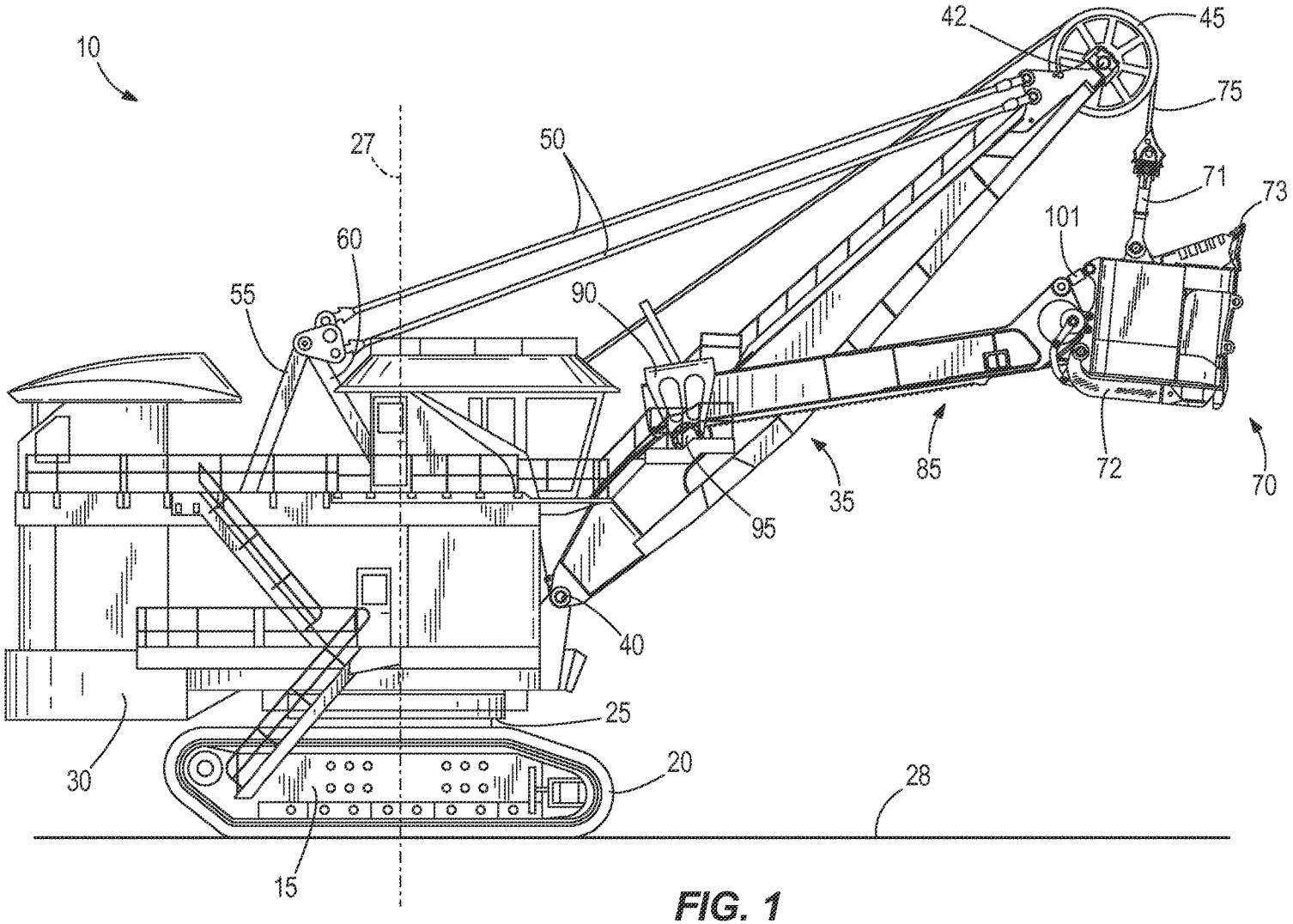
FIG. 1 is a side view of an industrial machine.

Although the invention described herein can be applied to, performed by, or used in conjunction with a variety of industrial machines, embodiments of the invention described herein are described with respect to an electric rope or power shovel, such as the power shovel 10 shown in FIG. 1. The shovel 10 includes a mobile base 15, a drive mechanism or tracks 20, a turntable 25, a revolving frame 30, a boom 35, a lower end 40 of the boom 35 (also called a boom foot), an upper end 42 of the boom 35 (also called boom point), tension cables 50, a gantry tension member 55, a gantry compression member 60, a dipper 70 having a door 72 and teeth 73, one or more hoist ropes 75, a winch drum (not shown), a dipper arm or handle 85, a saddle block 90, a shipper shaft 95 positioned in a shipper shaft aperture 96 (shown in FIG. 2), and a transmission unit (also called a crowd drive, not shown). The rotational structure 25 allows rotation of the upper frame 30 relative to the lower base 15. The turntable 25 defines a rotational axis 27 of the shovel 10. The rotational axis 27 is perpendicular to a plane 28 defined by the base 15 and generally corresponds to a grade of the ground or support surface.

The mobile base 15 is supported by the drive tracks 20. The mobile base 15 supports the turntable 25 and the revolving frame 30. The turntable 25 is capable of 360-degrees of rotation relative to the mobile base 15. The boom 35 is pivotally connected at the lower end 40 to the revolving frame 30. The boom 35 is held in an upwardly and outwardly extending relation to the deck by the tension cables 50, which are anchored to the gantry tension member 55 and the gantry compression member 60. The gantry compression member 60 is mounted on the revolving frame 30, and a sheave 45 is rotatably mounted on the upper end 42 of the boom 35.

The dipper 70 is suspended from the boom 35 by the hoist ropes 75. The hoist rope 75 is wrapped over the sheave 45 and attached to the dipper 70 at a bail 71. The hoist rope 75 is anchored to the winch drum (not shown) of the revolving frame 30. The winch drum is driven by at least one electric motor (not shown) that incorporates a transmission unit (not shown). As the winch drum rotates, the hoist rope 75 is paid out to lower the dipper 70 or pulled in to raise the dipper 70. The elongated member or dipper handle 85 is also coupled to the dipper 70. One or more pitch brace links 101 provide a connection between an upper portion of the handle 85 and an upper portion of the dipper 70. In one embodiment, a length of the pitch brace links 101 can be altered to adjust the angle of the dipper 70 relative to the handle 85. Aside from this adjustment, the dipper 70 is generally fixed relative to the handle 85. The dipper handle 85 is slidably supported in a saddle block 90, and the saddle block 90 is pivotally mounted to the boom 35 at the shipper shaft 95. The dipper handle 85 includes a rack tooth formation thereon that engages a drive pinion mounted in the saddle block 90. The drive pinion is driven by an electric motor and transmission unit to extend or retract the dipper handle 85 relative to the saddle block 90 and shipper shaft 95. Therefore, the handle 85 is movable relative to the boom 35 in both a rotational and translational manner.

An electrical power source is mounted to the revolving frame 30 to provide power to a hoist electric motor for driving the hoist drum, one or more crowd electric motors for driving the crowd transmission unit, and one or more swing electric motors for turning the turntable 25. Each of the crowd, hoist, and swing motors can be driven by its own motor controller or drive in response to control signals from a controller, as described below.

The shovel 10 also includes a controller (not shown) associated with the operation of shovel 10. The controller is electrically and/or communicatively connected to a variety of modules or components of the shovel 10. For example, the controller is connected to one or more sensors, a user interface, one or more hoist motors and hoist motor drives, one or more crowd motors and crowd motor drives, one or more swing motors and swing motor drives, etc. (these elements are not shown in the drawings). The controller includes combinations of hardware and software that are operable to, among other things, control operation of the power shovel 10, control the position of the boom 35, the dipper handle 85, the dipper 70, etc., monitor the operation of the shovel 10, etc. The sensors can include, among other things, position sensors, velocity sensors, speed sensors, acceleration sensors, an inclinometer, one or more motor field modules, etc.

In some embodiments, the controller includes a plurality of electrical and electronic components that provide power, operational control, and protection to the components and modules within the controller and/or shovel 10. For example, the controller includes, among other things, a processing unit (e.g., a microprocessor, a microcontroller, or another suitable programmable device), a memory, input units, and output units (not shown). The processor of the controller sends control signals to control the operations of the shovel 10. For example, the controller can monitor and/or control, among others, the digging, dumping, hoisting, crowding, and swinging operations of the shovel 10.

The goal of this invention is to provide a new boom and dipper handle for the shovel 10 that improves the performance of a shovel having an increased payload. By modifying the geometry (e.g., the configuration) and the positioning of the boom 35 and the handle 85, the invention improves tuck-back maneuverability and the digging envelope of the shovel, while also increasing the flat floor clean-up capability of the shovel. The invention also improves the truck-spotting range of a shovel's operator and improves the operator's line-of-sight. Further, the invention increases the structure life of the shovel's elements.

Figure 2:
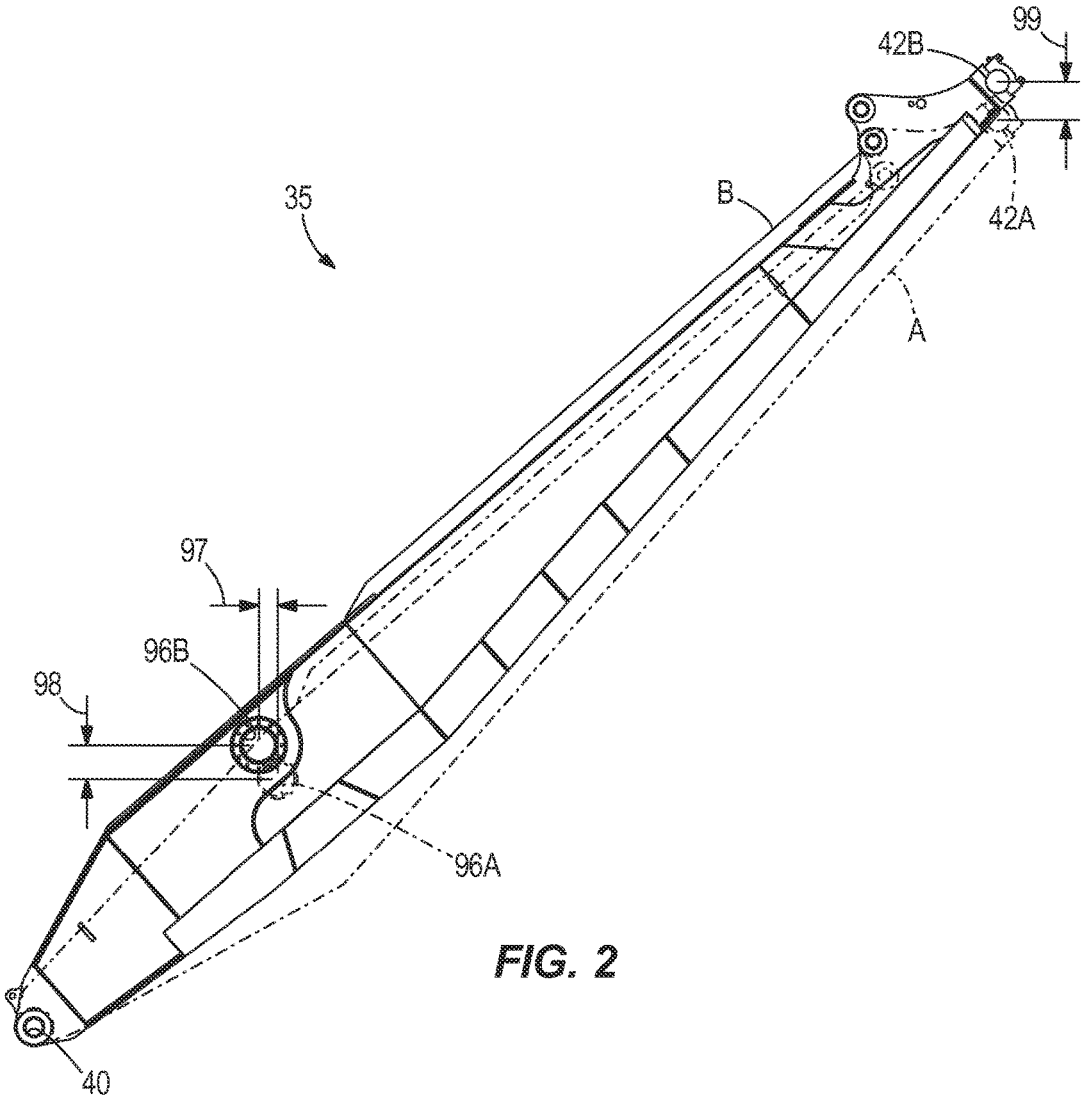
FIG. 2 is a side view of a boom for the industrial machine of FIG. 1 according to an embodiment of the invention.

FIG. 2 illustrates an improved boom 35B according to one embodiment of the invention and for use with the shovel 10. In FIG. 2, boom A (illustrated in broken lines) represents a conventional boom and boom B (illustrated in solid lines) represents the improved boom. The booms A, B are aligned about the boom foot 40, and each of the booms A, B defines a boom point 42 and a shipper shaft aperture 96 for receiving the shipper shaft 95. The shipper shaft 95B (FIG. 5) is in a position to pivotally support the handle 85B on the boom. The boom point 42 is the point of the boom where the boom connects to the sheave 45. As shown in FIG. 2, the shipper shaft aperture 96B of the boom B is located significantly closer to the rotational axis 27B (FIG. 5) of the shovel 10 when compared to shipper shaft aperture 96A for the boom A. For example, in some embodiments, a horizontal distance 97 between the shipper shaft aperture 96A of the boom A and the shipper shaft aperture 96B of the boom B is approximately 12 inches. In other words, the shipper shaft aperture 96B of the boom B is approximately 12 inches closer to the rotational axis 27B as compared to the shipper shaft aperture 96A of the boom A. In other embodiments, the shipper shaft aperture 96B is positioned even closer to the rotational axis 27B.

As shown in FIG. 2, the shipper shaft aperture 96B, and thereby the shipper shaft 95B of the boom 35B is positioned higher than the shipper shaft aperture 96A of the conventional boom A. In one embodiment, a vertical distance 98 between the shipper shaft aperture 96A of the boom A and the shipper shaft aperture 96B of the boom B is approximately 22 inches. Further, in one embodiment, a vertical distance 99 between the boom point 42A of the boom A and the boom point 42B of the boom B is approximately 22 inches. In other words, the boom point 42B of the improved boom B positioned higher than the boom point of the boom A. In other embodiments, the vertical distance 99 can be even larger.

Figure 3A:
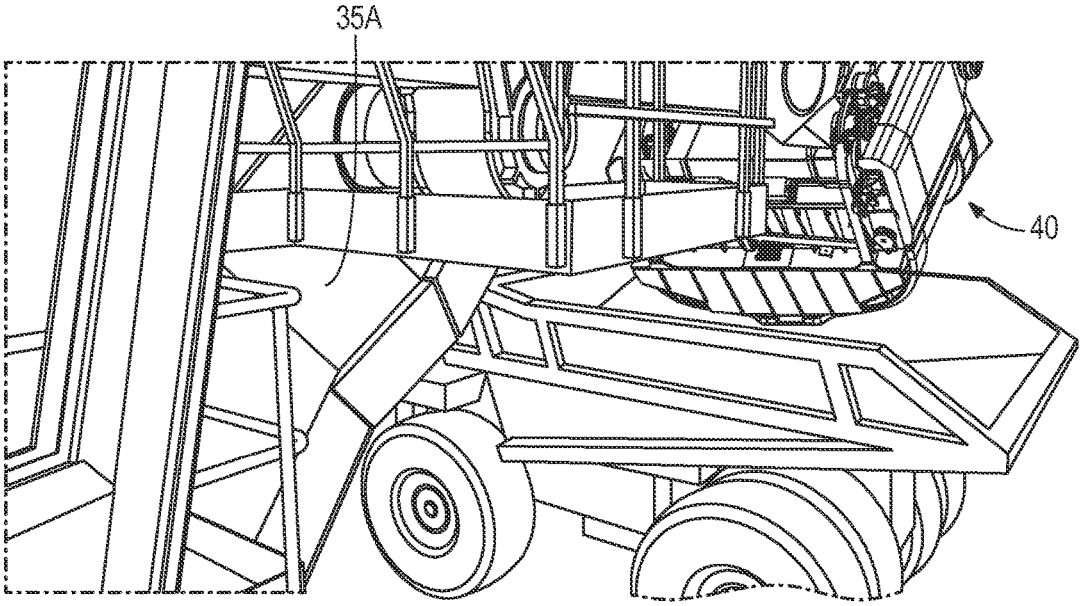
FIG. 3A is a perspective view of a dipper and loading vehicle for an industrial machine including a boom according to the prior art.
Figure 3B:
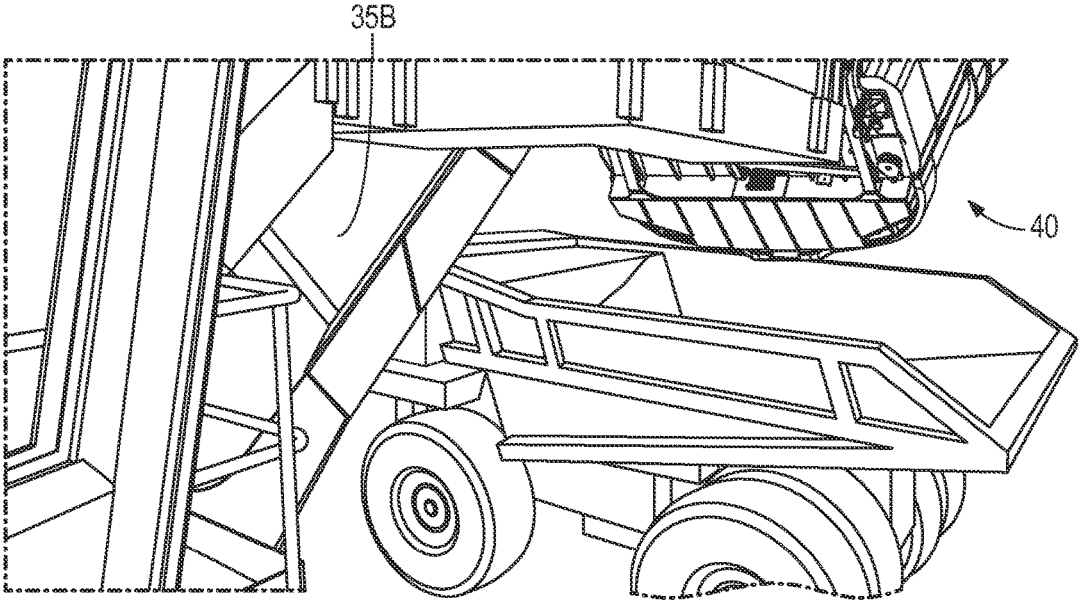
FIG. 3B is a perspective view of a dipper and loading vehicle for an industrial machine including the boom of FIG. 2.
Figure 3C:
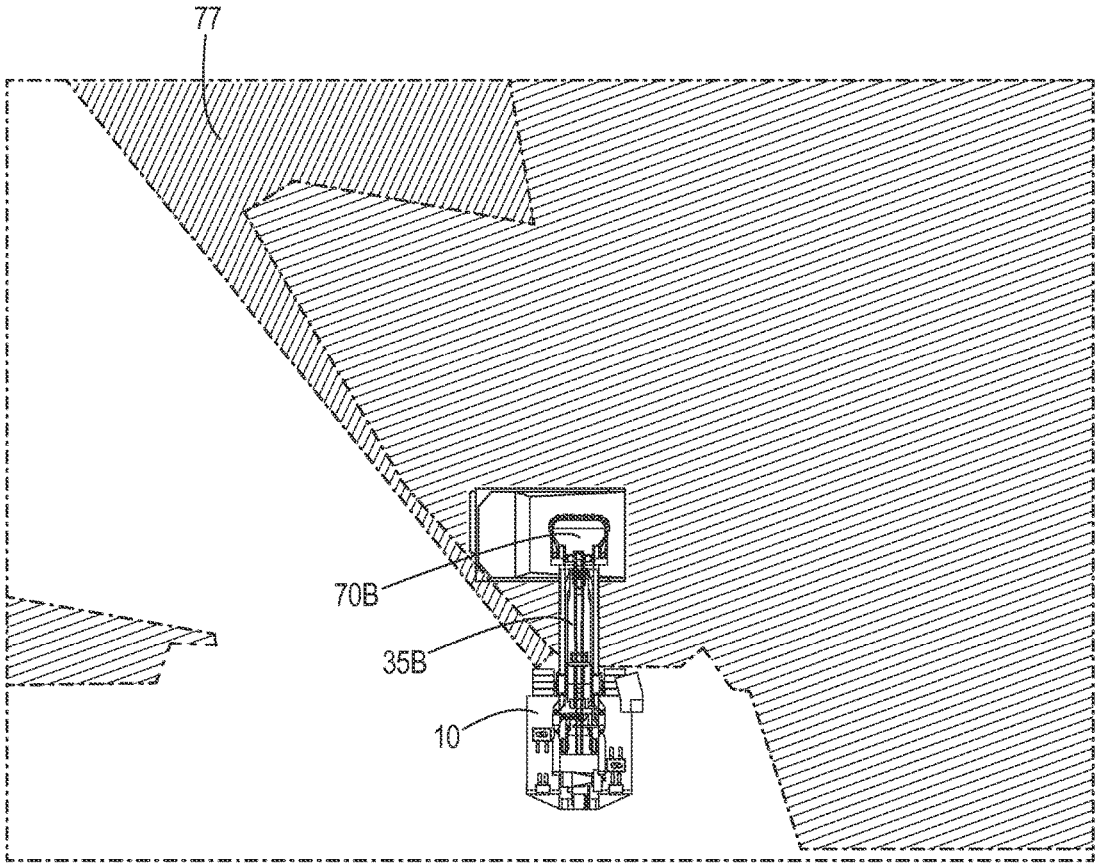
FIG. 3C illustrates a top view of an industrial machine and a loading vehicle.

Boom 35B has significant advantages over a boom A. For example, the new position of the shipper shaft aperture 96B improves visibility for the operator under the boom 35B. In some embodiments, the boom 35B improves (i.e., increases) the operator's ground visibility (i.e., the visibility of the area around the shovel 10) as well as the operator's visibility of the loading vehicle. FIG. 3A illustrates the view point of a shovel operator operating a shovel 10 with the boom A. FIG. 3B illustrates the improved view point of a shovel operator operating the shovel 10 with the boom 35B. In addition, FIG. 3C illustrates additional area 77 of the ground that is visible to the operator of the shovel 10 with the boom 35B.

Figure 4:
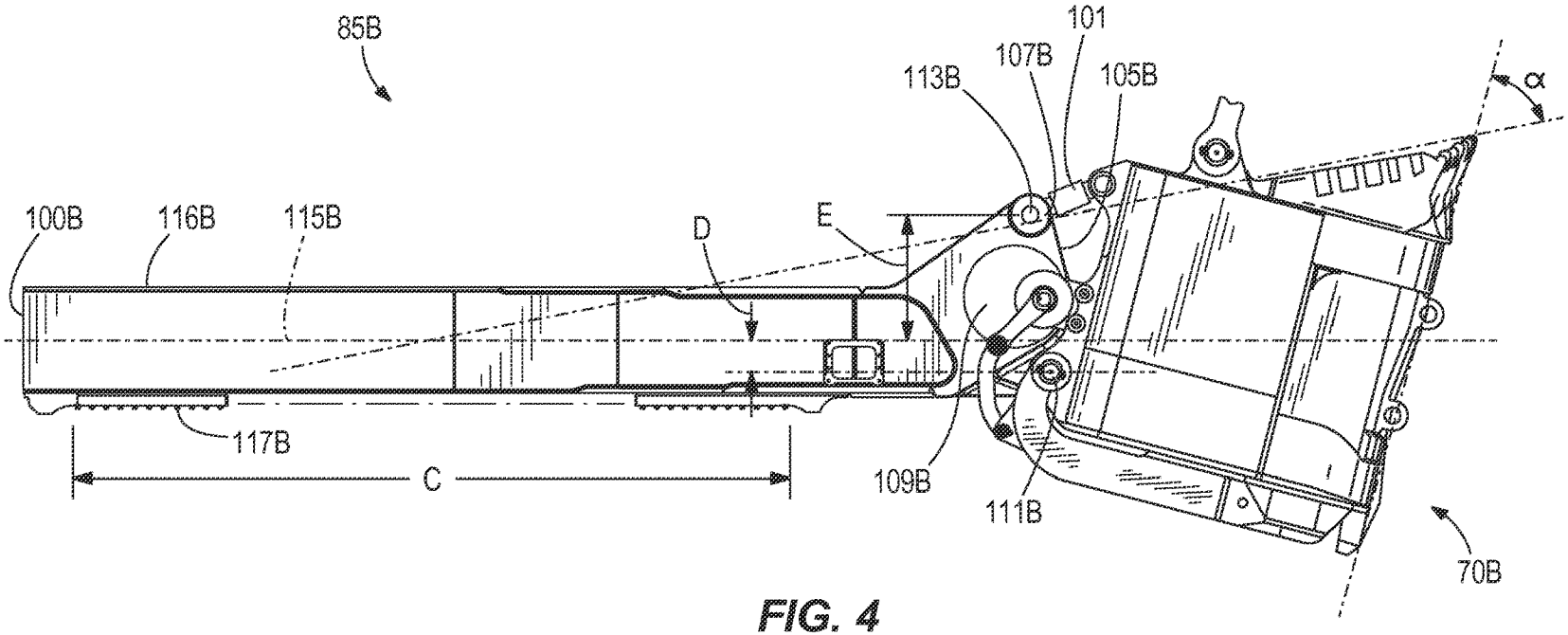
FIG. 4 is a side view of a handle for the industrial machine of FIG. 1 according to an embodiment of the invention.

FIG. 4 illustrates an improved dipper handle 85B according to one embodiment of the invention. The dipper handle 85B includes a first end 100B, which is coupled to the boom 35B (FIG. 2), and a second end 105B, which is coupled to the dipper 70B. The second end 105B of the handle 85B includes a first or upper dipper connection lug 107B, a second or lower dipper connection lug (not visible in FIG. 4), and a torsion box 109B. A lower dipper pin 111B, received by the lower lug, and an upper dipper pin 113B, received by the upper lug 107B through the pitch brace links 101, connect the dipper handle 85B to the dipper 70B. The length of the pitch brace links 101 is adjustable to allow the position and the angle of the dipper 70B relative to the handle 85B to be changed. Prior to operation, the pitch brace link 101 is locked so that the dipper 70B is fixed relative to the handle 85B. A rack 117B extends along a lower portion of the handle 85B and facilitates extension and retraction of the handle 85B with respect to the boom 35B. A center line 115B extends from the first end 100B to the second end 105B of the dipper handle 35B parallel to the bottom flat surface of the rack 117B. At the first end 100B of the handle 85B, the center line 115B is positioned at equal distance from a top plate 116B of the handle and a bottom flat surface of the rack 117B. Further, the second end 105B of the handle 85B and the attachment points (i.e., the dipper pins 111B and 113B) are not symmetrically positioned about the center line 115B. In one embodiment, the lugs and the torsion box 109B of the improved handle 85B are positioned approximately 24 inches higher in relation to the center line 115B when compared to a conventional dipper handle.

In one embodiment, a total length C of the rack 117B is approximately 318 inches. Further, a second lug distance D between the center line 115B and the lower dipper pin 111B is approximately 12 inches. Therefore, a ratio between the length C of the rack 117B and the second lug distance D is approximately 26.5:1 for the dipper handle 85B. In addition, a first lug distance E between the center line 115B and the upper dipper pin 113B is approximately 64 inches. Therefore, a lug ratio between the second lug distance D and the first lug distance E is approximately 1:5 for the dipper handle 85B. In some embodiments, the ratio between the second lug distance D and the first lug distance E is always different than 1:1 (e.g., 1:2, 1:6, 1:8, 1:10, etc.). At the same time, a tooth angle $\alpha$ of the dipper handle remains the same (i.e., the orientation of the dipper teeth with respect to a bank is the same). As explained in more detail below, the configuration of the dipper handle 85B increases flat-floor clean-up of the shovel 10 and allows greater tuck-back maneuverability and truck loading range because the torsion box 109B is pulled closer to the underside of the boom 35B before interference of the torsion box 109B with the boom 35B.

Figure 5:
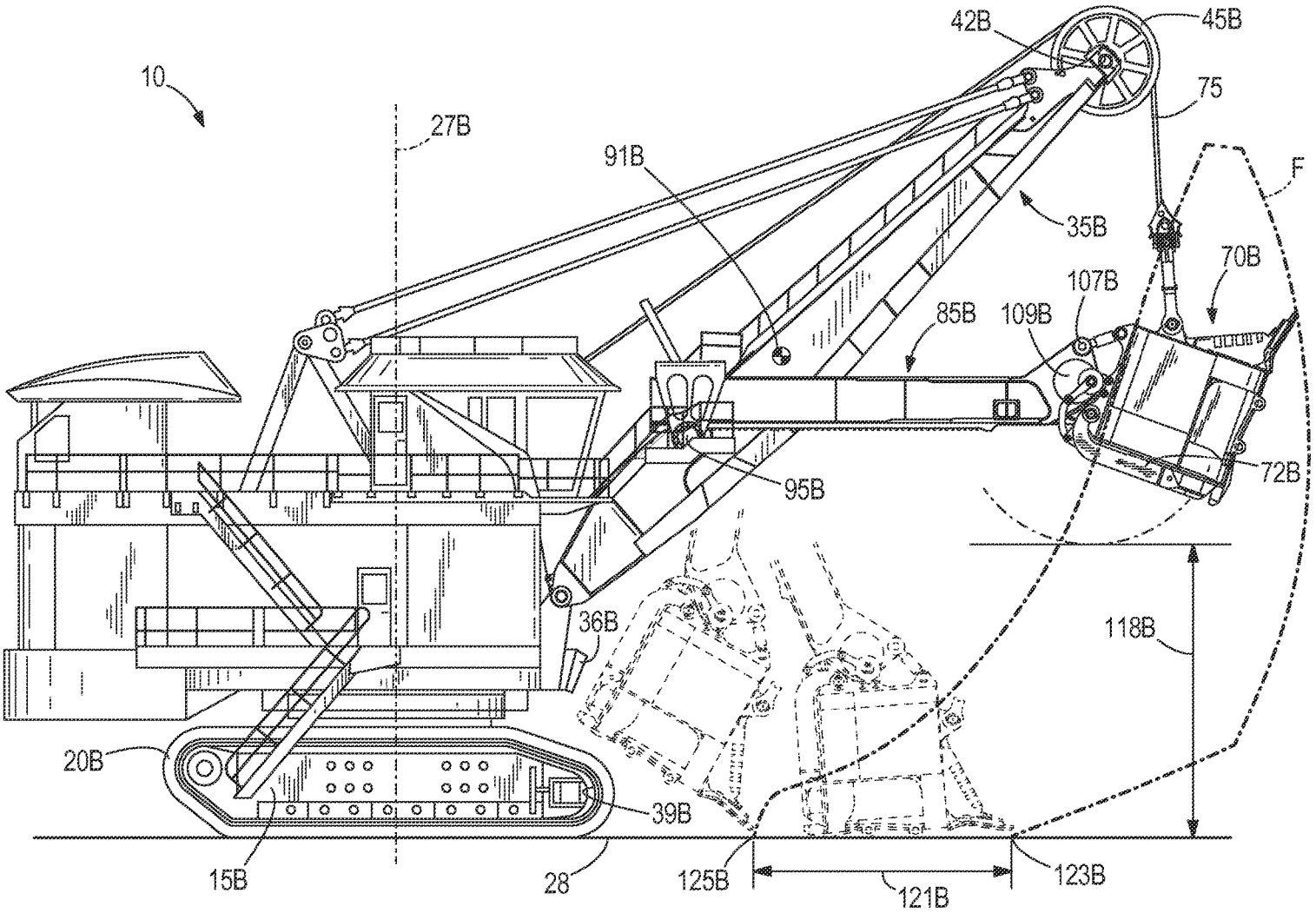
FIG. 5 is a side view of an electric rope shovel incorporating the boom of FIG. 2 and the handle of FIG. 4 according to an embodiment of the invention.

FIG. 5 illustrates the shovel 10 including the improved boom 35B and dipper handle 85B discussed above. As mentioned, the shipper shaft 95B of the boom 35B is moved approximately 12 inches closer to the rotational axis 27B of the shovel 10. Thus, maximum reach of the dipper 70B is closer to the frame of the shovel 10 and to the rotational axis 27B when compared to the reach of a conventional dipper that is supported by a conventional boom and handle. A center of gravity 91B of the boom 35B is also closer to the rotational axis 27B than a center of gravity of the boom 35A. Consequently, as a result of the improved boom 35B and dipper handle 85B, less counterweight is required to support the dipper 70B and the overall machine weight and inertia is reduced. Also, the reduced reach minimizes the overturning tipping moment of the shovel 10. Although the reach of the dipper 70B is closer to the rotational axis 27B than a conventional shovel, the new boom and handle configuration increases the active digging area of the shovel 10 in the low area of the bank and the outer region of a dig envelope "F" shown in FIG. 5. Therefore, in the illustrated embodiment, the dig envelope F of the dipper 70B is greater than a conventional shovel 10 by approximately 65 square feet, which improves the overall performance of the shovel 10.

FIG. 5 further illustrates a door clearance distance 118B (i.e., a distance from the ground or the plane 28B to a lower end of the dipper door 72B when the door 72B is open) of the shovel 10. By raising the shipper shaft 95B of the boom 35B, the lugs and the torsion box 109B of the handle 85B, the door clearance distance 118B of the shovel 10 increases as compared to a conventional shovel, which allows for easier maneuvering over a truck when the handle 85B of the shovel is in a horizontal position. Consequently, the shovel 10 can be accurately positioned relative to trucks with increased bed heights and the shovel operator can precisely unload the dipper. In some embodiments, the door clearance 118B of the shovel 10 is increased to approximately 281 inches (i.e., 46 inches more than a conventional shovel). In other words, the door clearance of the improved shovel increases approximately 19.5 percent as compared to a conventional shovel.

The configuration and attachment of the boom 35B and the handle 85B also improves flat floor cleanup of the shovel 10. In other words, the shovel 10 maintains a longer base of flat floor during every dig cycle. FIG. 5 shows an increased flat floor range 121B that is defined by the difference between an outermost distance 123B of flat floor reach from the rotational axis 27B and an innermost distance 125B of flat floor reach from the rotational axis 27B. In some embodiments, the outermost distance 123B of flat floor reach is approximately 647 inches and the innermost distance 125B of flat floor reach is approximately 345 inches. In one embodiment, the flat floor range 121B defined by the boom/handle configuration is approximately 302 inches, which is an approximately 12 inch increase when compared to conventional shovels. In other words, the flat floor range 121B of the improved shovel increases approximately 4 percent as compared to a conventional shovel. Thus, the outer most distance 123B of flat floor reach and the flat floor range 121B are both improved as compared to a conventional shovel.

The boom 35B and handle 85B further allows for improvement in vertical tuck-back maneuverability of the shovel 10. For example, a vertical handle distance 124B (FIG. 6) of the shovel 10 increases to approximately 56 inches, which is approximately 27 inches more than a conventional shovel. The vertical handle distance 124B is the distance between the tip of the teeth 73B and the plane 28B when the handle 85B is in a vertical orientation and refracted upwards to a position limited by the dipper 70B or when the torsion box 109B enters a collision zone with the boom. In other words, the vertical handle distance 124B of the shovel increases approximately 93 percent as compared to a conventional shovel. If only the boom 35B or the handle 85B are implemented in the shovel 10, increases to the vertical handle distance, albeit smaller, are also achieved. In addition, FIG. 7 illustrates a tooth radius 126B of the shovel 10 that relates to the improved tuck back maneuverability of the shovel. The tooth radius 126B is a distance from the tip of the dipper teeth 73B to the rotational axis 27B. As shown in FIG. 7, in one embodiment, the tooth radius 126B is approximately 337 inches (e.g., when the handle 85B is refracted upwards and backwards in a vertical and backward position until a bumper of the dipper 70B touches the boom 35B). In that embodiment, the vertical handle distance 124B increases by 17 inches from approximately 26 inches to approximately 43 inches. In other words, the vertical handle distance 124B of the improved boom and handle increase by about 65% as compared to a conventional shovel. This configuration improves the vertical and backward tuck-back maneuverability of the shovel 10.

In some situations, as the dipper 70B swings over a corner of crawler shoes 39B (FIG. 5), the dipper 70B may hit the shoes 39B. Generally, when the shipper shaft 95B is moved closer to the rotational axis 27B, interference between the dipper 70B and the shoes 39B of the shovel 10 increases. However, due to the improved handle 85B the dipper 70B is moved toward a more forward position (i.e., away from the rotational axis 27B as shown in FIG. 7), the new boom/handle configuration of the shovel 10 allows the shoe interference of the shovel 10 to remain unchanged.

Figure 6:
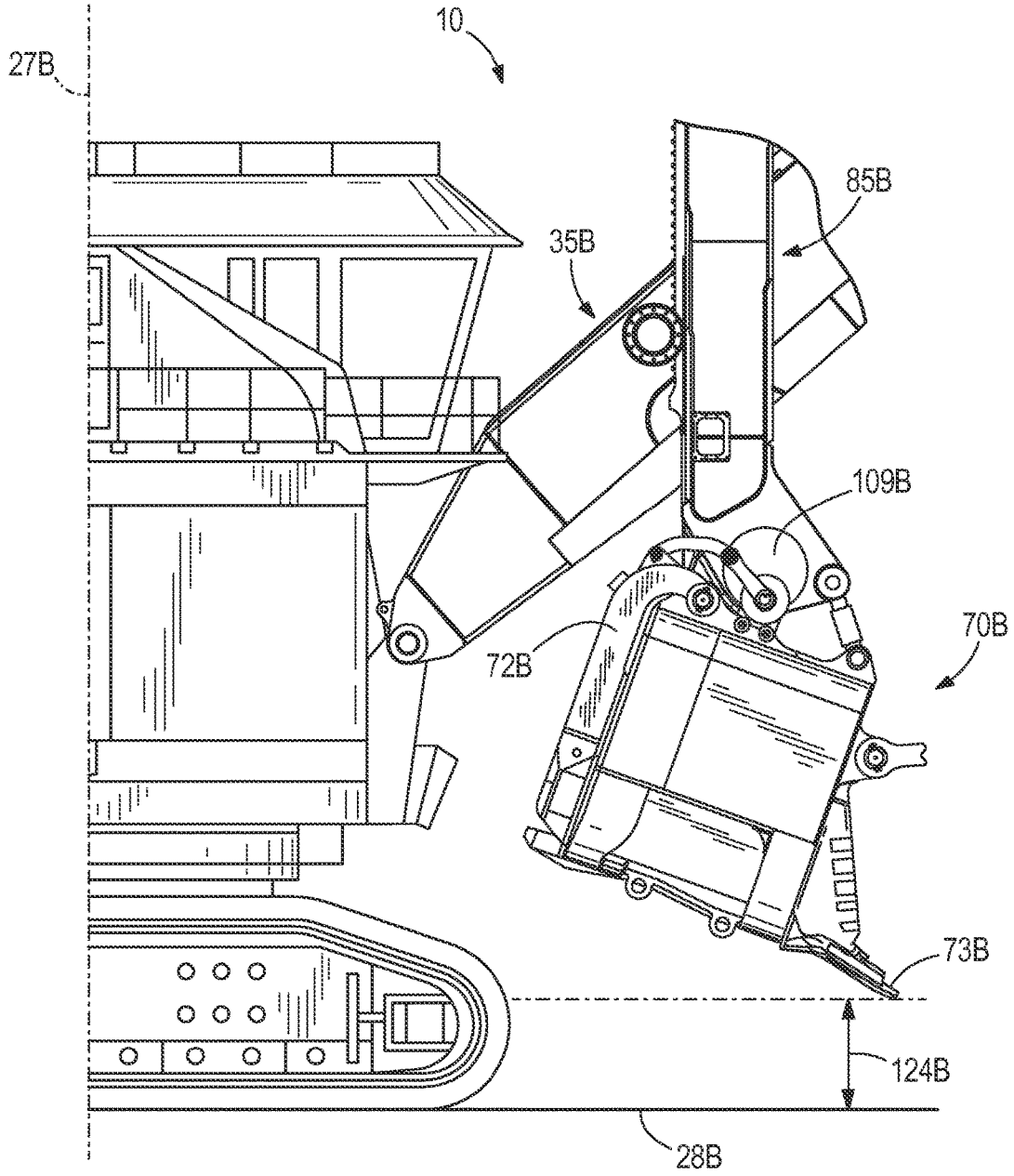
FIG. 6 is a side view of a portion of the electric rope shovel of FIG. 5 with the handle in a vertical orientation.
Figure 7:
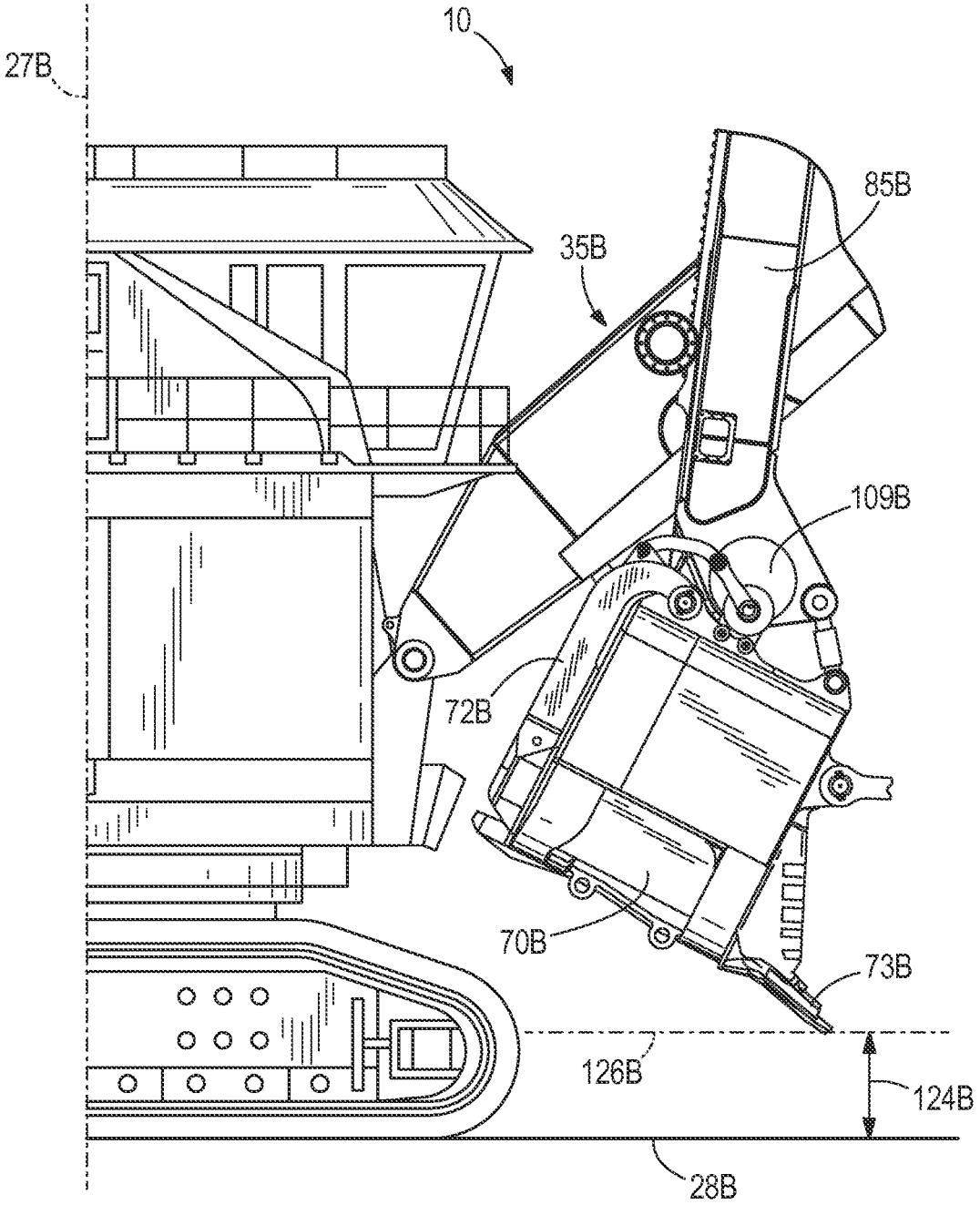
FIG. 7 is a side view of a portion of the electric rope shovel of FIG. 5 with the dipper in a tuck-back position.
Figure 8:
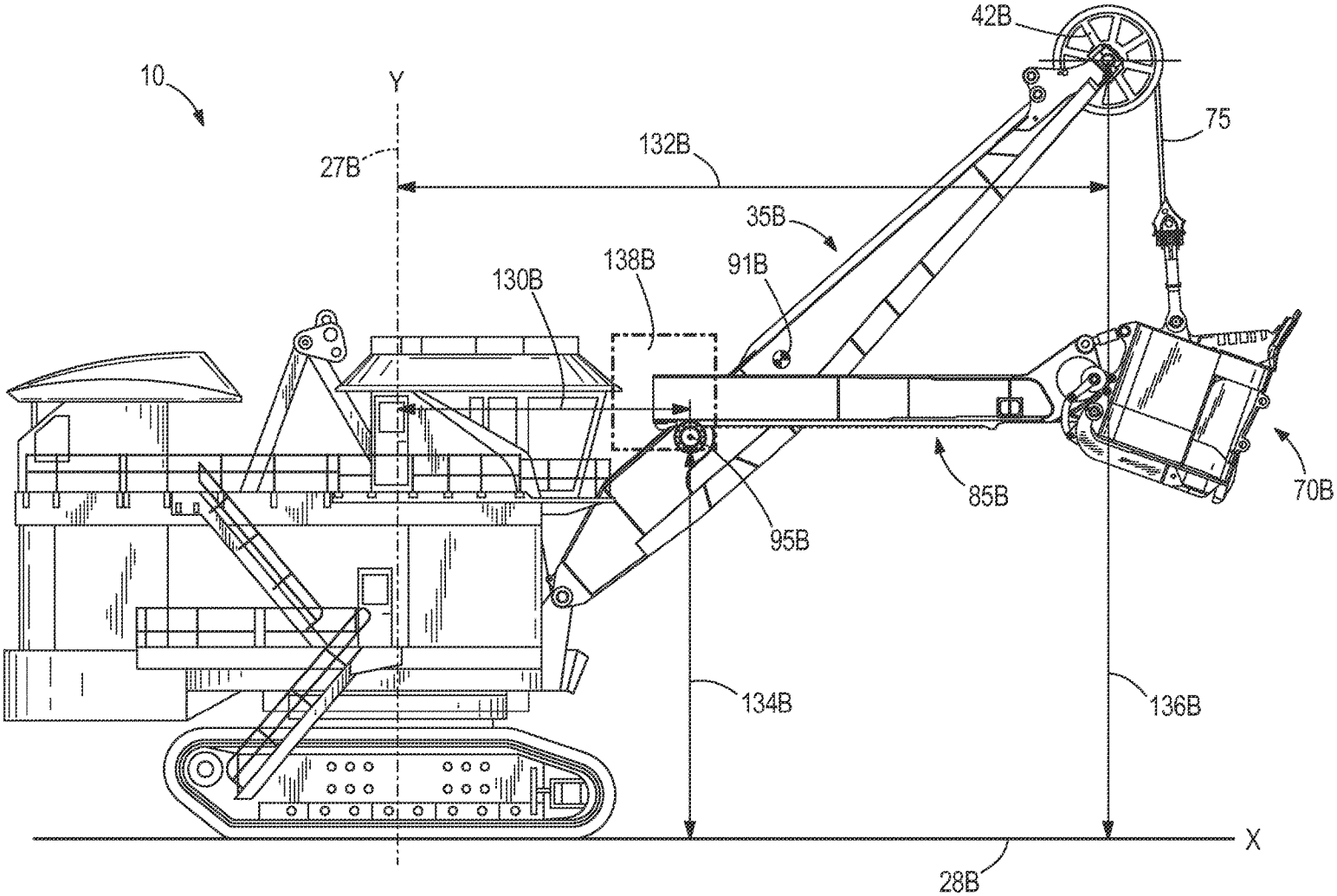
FIG. 8 is a side view of the electric rope shovel of FIG. 5.
Figure 9:
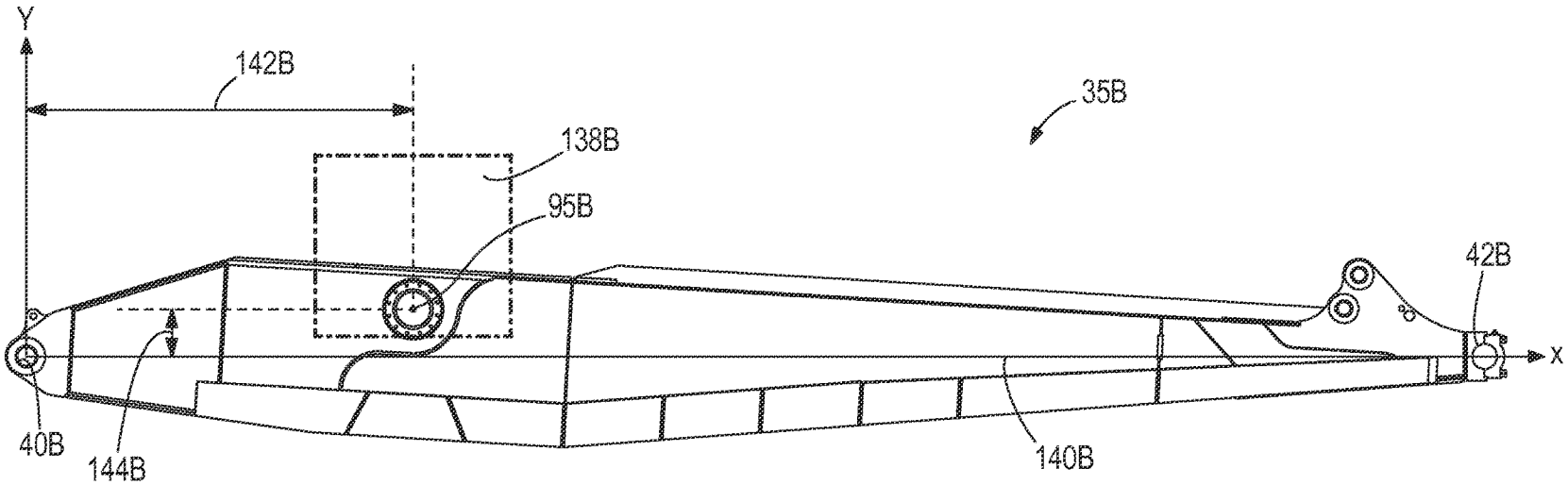
FIG. 9 is a side view of the boom of FIG. 2.
Figure 10:
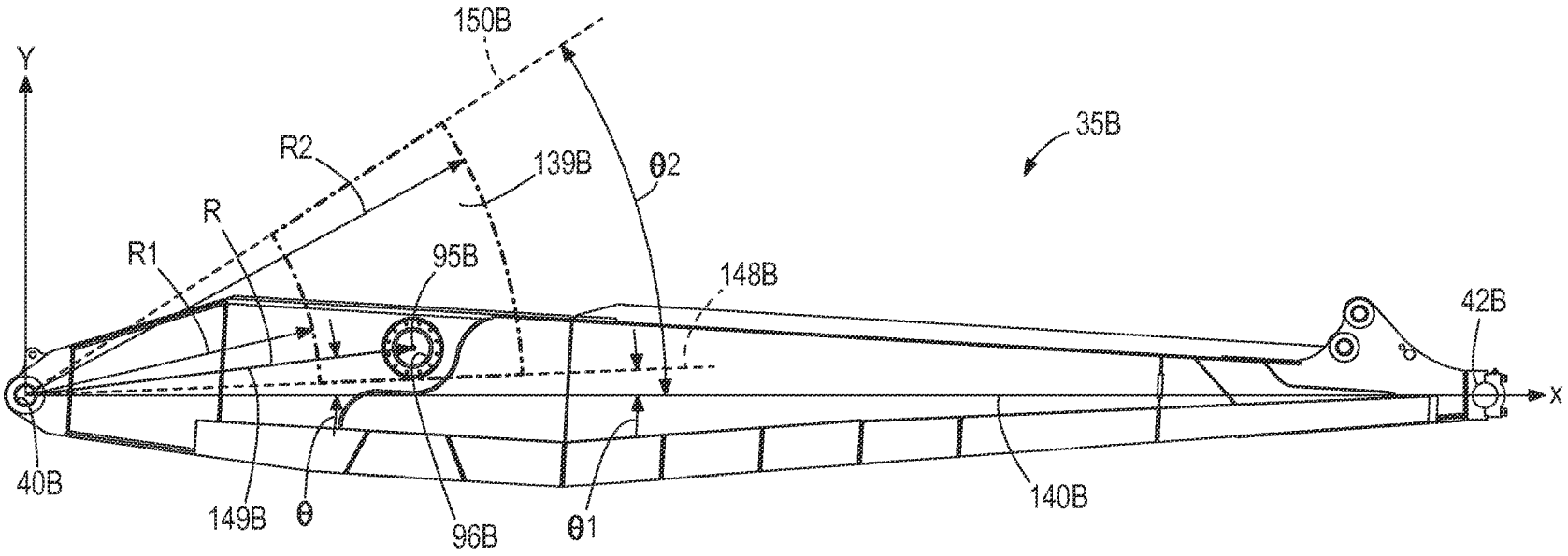
FIG. 10 is another side view of the boom of FIG. 2.

It is to be understood that FIGS. 5-7 illustrate one embodiment of the improved boom/handle configuration. In other embodiments, the position of the shipper shaft aperture 96B and the shipper shaft 95B on the boom 35B may be different, which will also change the position of the dipper handle 85B on the shovel 10. FIGS. 8-10 illustrate the shovel 10 and identify different possible positions for the shipper shaft aperture 96B and the shipper shaft 95B. The relationship of different points along the boom 35B and the shovel 10 are illustrated and discussed with respect to FIG. 8. The relevant points or locations along the boom 35B and the shovel 10 include the shipper shaft 95B, the rotational axis 27B, the boom point 42B, and the plane 28B.

As shown in FIG. 8, a first shipper shaft distance 130B is defined as a distance, in an X-direction, from the rotational axis 27B to the shipper shaft 95B. A first boom point distance 132B is defined as a distance, in the X-direction, from the rotational axis 27B to the boom point 42B. A second shipper shaft distance 134B is defined as a distance, in a Y-direction, from the shipper shaft 95B to the plane 28B. A second boom point distance 136B is defined as a distance, in the Y-direction, from the boom point 42B to the plane 28B. Area 138B represents a region that includes possible positions for the shipper shift 95B according to an embodiment of the invention.

In one embodiment, a length ratio between the first shipper shaft distance 130B and the first boom point distance 132B is approximately 0.39 (e.g., when the first shipper shaft distance 130B is approximately 285 inches and the first boom point distance 132B is approximately 728 inches). Further, a height ratio between the second shipper shaft distance 134B and the second boom point distance 136B is approximately 0.51 (e.g., when the second shipper shaft distance 134B is approximately 417 inches and the second boom point distance 136B is approximately 814 inches). Referring to FIG. 8, these ratios are used to define the position of area 138B within which the shipper shaft can be located for boom 35B. In one embodiment, a length of the area 138B in the X-direction is between approximately 27% and 43% of the first boom point distance 132B. Further, a height of the area 138B in the Y-direction is between approximately 50% and 64% of the second boom point distance 136B. Therefore, the shipper shaft 95B of the improved boom 35B can be positioned anywhere within the range of the area 138B and coupled to the improved handle 85B to achieve the shovel results described above.

FIG. 9 illustrates the improved boom 35B and the area 138B that represents the possible positions of the shipper shift 95B. As in FIG. 8, the relationship of different points along the boom 35B are illustrated and discussed with respect to FIG. 9. The relevant points or locations along the boom 35B include the boom foot 40B, the shipper shaft 95B, and the boom point 42B. A boom axis 140B (i.e., the boom length) is defined as a horizontal distance between the boom foot 40B and the boom point 42B. In some embodiments, the boom axis 140B is approximately 810 inches. A first reference distance 142B is defined as a distance from the boom foot 40B to the shipper shaft 95B in a direction parallel to the boom axis 140B. A second reference distance 144B is defined as a distance from the boom axis 140B to the shipper shaft 95B in a direction perpendicular to the boom axis 140B.

In one embodiment, a ratio between the first reference distance 142B and the boom axis 140B is approximately 0.265 (e.g., when the first reference distance 142B is approximately 215 inches). Further, a ratio between the second reference distance 144B and the boom axis 140B is approximately 0.032 (e.g., when the second reference distance 144B is approximately 26 inches). Referring to FIG. 9, these ratios are used to define the position of the area 138B on the boom 35B. In one embodiment, the maximum value for the ratio between the first reference distance 142B and the boom axis 140B is approximately 0.330 and the minimum value for the first ratio is approximately 0.200. In addition, the maximum value for the ratio between the second reference distance 144B and the boom axis 140B is approximately 0.143 and the minimum value for the second ratio is approximately 0.017. Consequently, the shipper shaft 95B of the improved boom 35B can be positioned within the range of the area 138B defined by the two ratios.

FIG. 10 illustrates the boom 35B and an annulus shape area 139B that represents possible positions of the shipper shaft 95B. As in FIGS. 8 and 9, the relationship of different points along the boom 35B are illustrated and discussed with respect to FIG. 10. The relevant points or locations along the boom 35B include the boom foot 40B, the shipper shaft aperture 96B (and thereby the shipper shaft 95B), and the boom point 42B. In the illustrated embodiment, the position of the shaft aperture 96B is identified by an angle θ defined between the boom axis 140B and a line 149B extending from the boom foot 40B through the center of the shaft aperture 96B. In this embodiment, the angle θ is approximately 7 degrees. Further, a first angle θ1 is defined between the boom axis 140B and a line 148B extending through a lower most region of the annulus area 139B. A second angle θ2 is defined between the boom axis 140B and a line 150B extending through an upper most region of the annulus area 139B. In the illustrated embodiment, the angle θ1 is approximately 3 degrees and the angle θ2 is approximately 36 degrees.

In the illustrated embodiment, a reference distance or radius R is defined between the boom foot 40B and the center of the shaft aperture 96B. It this embodiment, the reference distance R is approximately 216 inches or 27% percent from the boom axis 140B. The angle θ and the reference distance R define the position of the shaft aperture 96B (and thereby the shipper shaft 95B) in the illustrated embodiment. Further, a reference distance or radius R1 is defined as a distance from the boom foot 40B to the innermost curved region of the annulus area 139B. A reference distance or radius R2 is defined as a distance from the boom axis 140B to the outermost curved region of the annulus area 139B. In the illustrated embodiment, the reference distance R1 is approximately 20 percent from the boom axis 140B (i.e., 162 inches) and the reference distance R2 is approximately 33 percent from the boom axis 140B (i.e., 267.5 inches). The angles θ1/θ2 and the reference distances R1/R2 define the boundaries of the annulus shape area 139B. The shaft aperture 96B and the shipper shaft 95B of the improved boom 35B can be positioned within the area 139B.

Thus, the invention provides, among other things, a boom and dipper handle assembly for an industrial machine. Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A mining machine supported on a support surface, the mining machine comprising:

a base including a frame portion that is rotatable relative to the support surface about a machine axis;

a boom including a first end coupled to the base, a second end opposite the first end, and a sheave coupled to the second end of the boom, a first distance being defined between the machine axis and the second end of the boom, a first height defined between the support surface and the second end of the boom;

a hoist rope extending over the sheave;

a member movably coupled to the boom about a pivot point that is positioned substantially between the first end and the second end of the boom, the member including a first end and a second end, a second distance being defined between the machine axis and the pivot point, a length ratio of the second distance to the first distance being between 27% and 39%, a second height defined between the support surface and the pivot point, a height ratio of the second height to the first height being between 51% and 64%; and a dipper coupled to the second end of the member and being supported by the hoist rope such that the hoist rope raises the dipper as the rope is reeled in.

2. The shovel of claim 1, wherein the member is rotationally and translationally movable relative to the boom.

3. The mining machine of claim 1, wherein the length ratio of the second distance to the first distance is between 35% and 39%.

4. The mining machine of claim 3, wherein the length ratio of the second distance to the first distance is approximately 39%.

5. The mining machine of claim 1, wherein the height ratio of the second height to the first height is between 51% and 57%.

6. The mining machine of claim 5, wherein the height ratio of the second height to the first height is approximately 51%.

7. The mining machine of claim 1, wherein the member defines a longitudinal axis between the first end and the second end, the second end of the member including a first lug and a second lug, the first lug being coupled to the dipper and positioned on one side of the longitudinal axis, the second lug being coupled to the dipper and positioned on an opposite side of the axis from the first lug, the positions of the first lug and the second lug being asymmetric about the longitudinal axis.

8. The mining machine of claim 7, wherein the first lug is positioned a first lug distance from the longitudinal axis and the second lug is positioned a second lug distance from the longitudinal axis, a lug ratio of the first lug distance to the second lug distance being greater than or equal to approximately 2:1.

9. The mining machine of claim 8, wherein the lug ratio is approximately 5:1.

10. A mining machine supported on a support surface, the mining machine comprising:

a base;

a boom including a first end coupled to the base, a second end opposite the first end, and a sheave coupled to the second end of the boom;

a hoist rope extending over the sheave; and a member movably coupled to the boom about a pivot point that is positioned substantially between the first end and the second end of the boom, the member including a first end and a second end, the member defining a centerline axis extending between the first end and the second end and substantially bisecting the member into a lower portion and an upper portion, the member further including a torsion box positioned proximate the second end of the member, the center of the torsion box being offset from the centerline axis, the member further including a first lug and a second lug; and a dipper coupled to the first lug and the second lug and being supported by the hoist rope, the hoist rope raising the dipper as the rope is reeled in.

11. The mining machine of claim 10, wherein a first height is defined between the support surface and the second end of the boom, wherein a second height is defined between the support surface and the pivot point, and wherein a height ratio of the second height to the first height is between 50% and 64%.

12. The mining machine of claim 11, wherein the height ratio of the second height to the first height is between 50% and 57%.

13. The mining machine of claim 12, wherein the height ratio of the second height to the first height is approximately 51%.

14. The mining machine claim 10, wherein the first lug is positioned in the upper portion of the member and spaced from the centerline axis by a first distance, the second lug positioned in the lower portion of the member and spaced from the centerline axis by a second distance, a lug ratio of the first distance to the second distance being between approximately 5:1 and approximately 10:1.

15. The mining machine of claim 14, wherein the lug ratio is approximately 5:1.

16. A boom for a mining machine, the mining machine including a base and a handle, the boom comprising:

a first end adapted to be coupled to the base;

a second end adapted to support a sheave;

a boom axis extending through the first end and the second end, a boom distance defined between the first end and the second end; and a shipper shaft extending transversely through a width of the boom, the shipper shaft being positioned between the first end and the second end, a first distance being defined between the first end of the boom and the shipper shaft, a first ratio of the first distance to the boom distance being between 20% and 30%, a second distance defined between the boom axis and the shipper shaft, a second ratio of the second distance to the boom distance being between 1.7% and 14.3%.

17. The boom of claim 16, wherein the first ratio of the first distance to the boom distance is between 23% and 30%.

18. The boom of claim 17, wherein the first ratio of the first distance to the boom distance is approximately 26.5%.

19. The boom of claim 16, wherein the second ratio of the second distance to the boom distance is between 1.7% and 9%.

20. The boom of claim 19, wherein the second ratio of the second distance to the boom distance is approximately 3.2%.

21. A boom of claim 16, wherein a radius is defined by a line extending between the first end of the boom and the shipper shaft and an angle is defined between the radius and the boom axis, the angle being between approximately 3 degrees and 36 degrees.

22. The boom of claim 21, wherein the angle between the radius and the boom axis is between approximately 3 degrees and 12 degrees.

23. The boom of claim 22, wherein the angle between the radius and the boom axis is approximately 7 degrees.

24. The boom of claim 23, wherein the boom axis defines a first side of the boom proximate a dipper coupled to the handle and a second side positioned away from a dipper, the shipper shaft being positioned on the second side of the boom.

25. A rope shovel comprising:

a base;

a boom including a first end coupled to the base and a second end, a boom axis extending through the first end and the second end, a distance between the first end and the second end along the boom axis defining a boom length;

a hoist rope extending over the second end of the boom;

a shipper shaft extending transversely through a width of the boom and positioned between the first end and the second end of the boom, a radius extending between the first end of the boom and the shipper shaft and defining an angle with respect to the boom axis about the first end of the boom, the radius being between approximately 20% and approximately 30% of the boom length, the angle being between approximately 3 degrees and approximately 36 degrees;

a member movably coupled to the boom about the shipper shaft, the member including a first end and a second end; and a digging attachment coupled to the second end of the member, the digging attachment supported by the hoist rope such that the hoist rope raises the digging attachment as the rope is reeled in.

26. The rope shovel of claim 25, wherein the radius is between approximately 23% and approximately 30% of the boom length.

27. The rope shovel of claim 26, wherein the radius is approximately 26.5% of the boom length.

28. The rope shovel of claim 25, wherein the angle between the radius and the boom axis is between approximately 3 degrees and approximately 12 degrees.

29. The rope shovel of claim 28, wherein the angle between the radius and the boom axis is approximately 7 degrees.

30. The rope shovel of claim 25, wherein the boom defines a first side proximate the digging attachment and a second side opposite the first side, wherein the shipper shaft is positioned on the second side of the boom.

* * * * *